US009047845B2

(12) United States Patent
Kitagawa et al.

(10) Patent No.: US 9,047,845 B2
(45) Date of Patent: Jun. 2, 2015

(54) DRIVE CIRCUIT AND LIQUID CRYSTAL DISPLAY DEVICE

(75) Inventors: Daiji Kitagawa, Osaka (JP); Kouji Kumada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 365 days.

(21) Appl. No.: 13/578,731

(22) PCT Filed: Jan. 27, 2011

(86) PCT No.: PCT/JP2011/051648

§ 371 (c)(1),
(2), (4) Date: Aug. 13, 2012

(87) PCT Pub. No.: WO2011/102202

PCT Pub. Date: Aug. 25, 2011

(65) Prior Publication Data

US 2012/0313924 A1 Dec. 13, 2012

(30) Foreign Application Priority Data

Feb. 19, 2010 (JP) ..... 2010-034980

(51) Int. Cl.
*G09G 3/36* (2006.01)
*G09G 5/00* (2006.01)
*G09G 3/20* (2006.01)

(52) U.S. Cl.
CPC ..... *G09G 3/3696* (2013.01); *G09G 2300/0857* (2013.01); *G09G 3/3614* (2013.01); *G09G 5/003* (2013.01); *G09G 5/005* (2013.01); *G09G 3/2092* (2013.01)

(58) Field of Classification Search
CPC . G09G 3/36; G09G 3/3611; G09G 2330/022; G09G 3/3648–3/3696
USPC ..... 345/208–213, 87, 90–92, 94–99
See application file for complete search history.

(56) References Cited

U.S. PATENT DOCUMENTS

2002/0171607 A1 11/2002 Senda et al.
2003/0011586 A1 1/2003 Nakajima
(Continued)

FOREIGN PATENT DOCUMENTS

JP 10-097226 A 4/1998
JP 2002-175049 A 6/2002
(Continued)

OTHER PUBLICATIONS

English translation of JP 2009258616 A.*
(Continued)

*Primary Examiner* — Nathan Danielsen
(74) *Attorney, Agent, or Firm* — Keating & Bennett, LLP

(57) ABSTRACT

Provided is a drive circuit including: an image supply section for supplying an image to be displayed on a liquid crystal panel (2); a command issuing section for issuing a command that instructs an image displayed on the liquid crystal panel (2) to be updated; a low-speed oscillation circuit (13) for supplying a low-speed clock signal (L-CLK); a high-speed oscillation circuit (8) for supplying a high-speed clock signal (H-CLK) higher in frequency than the low-speed clock signal (L-CLK); image outputting means for supplying, to the liquid crystal panel (2), the image from the image supplying means, the image outputting means being driven by the high-speed clock signal (H-CLK); and a logic section (10) for controlling, in accordance with the command issued by the command issuing section, whether or not to cause the high-speed oscillation circuit (8) to operate, the logic section (10) being driven by the low-speed clock signal (L-CLK).

8 Claims, 6 Drawing Sheets

(56) References Cited

U.S. PATENT DOCUMENTS

2004/0036669 A1 2/2004 Yanagi et al.
2009/0207117 A1* 8/2009 Chen et al. ..... 345/96

FOREIGN PATENT DOCUMENTS

JP 2002-311907 A 10/2002
JP 2003-099006 A 4/2003
JP 2004-078124 A 3/2004
JP 2007-121699 A 5/2007
JP 2009258616 A * 11/2009

OTHER PUBLICATIONS

Official Communication issued in International Patent Application No. PCT/JP2011/051648, mailed on Apr. 26, 2011.

* cited by examiner

DRIVE CIRCUIT AND LIQUID CRYSTAL DISPLAY DEVICE

TECHNICAL FIELD

The present invention relates to (i) a drive circuit for driving a liquid crystal panel in which a memory circuit is included in each pixel and (ii) a liquid crystal display device.

BACKGROUND ART

Some liquid crystal panels are different in structure from normal liquid crystal panels, and are configured such that a memory circuit is included in each pixel (hereinafter referred to as a pixel memory). In order for a still image to be displayed on such a liquid crystal panel, it is only necessary that data of the still image be retained in the pixel memory. This makes it unnecessary to continue sending (scanning) the image. Therefore, a high-speed clock signal, which has been required for continuing to send the image, becomes unnecessary except when the image is rewritten (that is, unnecessary while a still image is being displayed).

FIG. 6 is a block diagram illustrating a conventional liquid crystal display device 101. The liquid crystal display device 101 includes (i) a liquid crystal panel 102 in which a pixel memory is included in each pixel and (ii) a liquid crystal panel driving circuit 103. The liquid crystal panel 102 includes a gate driver 109.

[Liquid Crystal Panel Driving Circuit 103]

The liquid crystal panel driving circuit 103 includes an MPU (Micro-Processing Unit) 104 and an LCD (liquid crystal display) driver 105 (LCD controller).

The LCD driver 105 includes an MPU interface 106, an image storing RAM (Random Access Memory) 107*a*, a source driver 107*b*, a high-speed oscillation circuit 108, a frequency dividing section 110, a polarity-reversed signal output section 111, and a power supply circuit 112 (booster circuit).

In FIG. 6, the power supply circuit 112 and the polarity-reversed signal output section 111 are required to operate constantly by a low-speed clock signal L-CLK (described later). The power supply circuit 112 supplies a power supply voltage V1*cd* and electric power to the liquid crystal panel 102. Further, the power supply circuit 112 supplies an internal circuit power supply voltage to an internal circuit of the liquid crystal panel driving circuit 103, which is an IC (Integrated Circuit). In addition, the power supply circuit 112 supplies a power supply voltage V1 to the polarity-reversed signal output section 111 and supplies a power supply voltage V2 to the source driver 7*b*.

The polarity-reversed signal output section 111 supplies signals VA and VB to the liquid crystal panel 102, and supplies a signal Vcom (described later) to a common electrode COM (not illustrated) of the liquid crystal panel 102.

According to the liquid crystal panel driving circuit 103, image data is supplied from the MPU 104 to the image storing RAM 107*a* via the MPU interface 106, and is written to the image storing RAM 107*a*. In this way, an image to be displayed on the liquid crystal panel 102 is supplied. The image data is written in accordance with a write pulse (pulse signal) supplied from the MPU 104, which write pulse serves as a clock signal (writing clock signal). Therefore, it is not necessary to provide an oscillation circuit exclusively for writing image data.

The high-speed oscillation circuit 108 supplies a high-speed clock signal H-CLK to the source driver 107*b* and to the frequency dividing section 110, and supplies a gate start pulse signal GSP and a high-speed clock signal H-CLK (gate clock signal GCK) to the gate driver 109. This causes image data to be supplied from the image storing RAM 107*a* to the liquid crystal panel 102 via the source driver 107*b*, and selection signals S11, •S12, • . . . • and S1*n* to be supplied from the gate driver 109 to a display region 102*a* of the liquid crystal panel 102. In this way, an image is displayed on the liquid crystal panel 102.

The image data written to the image storing RAM 107 is supplied via a bus between the image storing RAM 107 and the liquid crystal panel 102.

The frequency dividing section 110 divides the high-speed clock signal H-CLK supplied from the high-speed oscillation circuit 108 to generate a low-speed clock signal L-CLK. The low-speed clock signal L-CLK thus generated is supplied to the polarity-reversed signal output section 111 and the power supply circuit 112.

In the liquid crystal display device 101 shown in FIG. 6, in order for the pixels of the liquid crystal panel 102 to retain pixel values, it is necessary to reverse polarity of the signals Vcom that is constantly supplied to the common electrode COM and polarities of the signals VA and VB.

Note here that the low-speed clock signal L-CLK, which is required for supplying the signals Vcom, VA, and VB, is slower (lower in frequency) than the high-speed clock signal H-CLK. As described earlier, the high-speed clock signal H-CLK is not necessary while a still image is being displayed. However, according to the liquid crystal display device 101 shown in FIG. 6, it is necessary to continue supplying the high-speed clock signal H-CLK in order to supply the low-speed clock signal L-CLK, even while a still image is being displayed. This leads to excess power consumption.

Under this circumstances, Patent Literatures 1 and 2 each disclose an invention for preventing excess power consumption while pixels are not being rewritten. The Patent Literature 1 discloses a liquid crystal driving device which includes two oscillation circuits (specifically, a high-speed oscillation circuit and a low-speed oscillation circuit) and causes the high-speed oscillation circuit to operate only when an image is rewritten.

FIG. 7 is a view corresponding to FIG. 1 of Patent Literature 1. The liquid crystal driving device shown in FIG. 7 includes an MPU interface 210, a bus holder 220, a VRAM control 230, and a timing control 240. The liquid crystal driving device further includes a high-frequency oscillation circuit 250 (a high-speed oscillation circuit) used only when an image is rewritten and a low-frequency oscillation circuit 270 (a low-speed oscillation circuit).

On the other hand, Patent Literature 2 discloses a drive circuit in which a power supply circuit operates only when an image is rewritten and does not operate at other times. FIG. 8 is a view corresponding to FIG. 1 of the Patent Literature 2. The drive circuit shown in FIG. 8 includes a line driver 121, a column driver 131, an MPU interface section 141, a command decoder 142, a timing generator circuit 143, an oscillation circuit 144, a display data RAM 145, and an address control circuit 146. The drive circuit further includes a power supply circuit 155. The power supply circuit 155 operates only when an image is rewritten and does not operate at other times.

CITATION LIST

Patent Literatures

Patent Literature 1

Japanese Patent Application Publication, Tokukaihei, No. 10-97226 A (Publication Date: Apr. 14, 1998)

Patent Literature 2

Japanese Patent Application Publication, Tokukai, No. 2003-99006 A (Publication Date: Apr. 4, 2003)

SUMMARY OF INVENTION

Technical Problem

The liquid crystal driving device shown in FIG. 7 includes two oscillation circuits (250, 270), and these two oscillation circuits operate independently of each other. According to the configuration, the two oscillation circuits do not cooperate with each other, and thus less power is saved. Further, since the two oscillation circuits operate individually without cooperation, rewriting of an image may coincide with polarity reversal of an output voltage. The polarity reversal is carried out to prevent a direct current from being applied to liquid crystal elements. As a result, coupling may occur due to a voltage change at the time of the polarity reversal, and thus the image may not be properly written.

Furthermore, Patent Literature 2 only mentions that the drive circuit shown in the FIG. 8 stops operation of the power supply circuit 155 when images are not rewritten, and does not describe changing the capability of the power supply (that is, does not describe changing the amount of electric power that the power supply circuit supplies). According to a liquid crystal panel in which a pixel memory is included in each pixel, it is not possible to stop operation of the power supply completely. Therefore, it is not possible to apply the drive circuit shown in FIG. 8 to the liquid crystal panel in which a pixel memory is included in each pixel.

The present invention has been made in view of the above conventional problems, and an object of the present invention is to provide a drive circuit and a liquid crystal display device each of which is more power-saving than conventional drive circuits.

Solution to Problem

In order to attain the above object, a drive circuit of the present invention is a drive circuit for driving a display section, including: image supplying means for supplying an image to be displayed on the display section; command issuing means for issuing a command that instructs an image displayed on the display section to be updated; first oscillation circuit for supplying a first clock signal; second oscillation circuit for supplying a second clock signal that is higher in frequency than the first clock signal; image outputting means for supplying, to the display section, the image supplied from the image supplying means, the image outputting means being driven by the second clock signal; and second oscillation circuit controlling means for controlling, in accordance with the command issued by the command issuing means, whether or not to cause the second oscillation circuit to operate, the second oscillation circuit controlling means being driven by the first clock signal.

According to the above invention, it is possible to (i) cause the second oscillation circuit to operate when a command that indicates the image displayed on the display section to be updated is issued and (ii) cause the second oscillation circuit to stop operating when a command that instructs a still image to be displayed is issued.

That is, the drive circuit causes the second oscillation circuit not to operate except when the image displayed on the display is rewritten.

Since the second oscillation circuit does not operate constantly like above, the drive circuit is more power-saving than conventional drive circuits.

Note that, out of the two oscillation circuits, the first oscillation circuit serves as a master of the entire drive circuit (i.e., the first clock signal serves as a master clock signal). This controls a polarity-reversed signal output section and a power supply circuit, which are required to operate constantly.

Further, the second oscillation circuit, which needs to be controlled locally, is controlled to operate or not to operate by the second oscillation circuit controlling means. Note, however, that the second oscillation circuit controlling means operates in accordance with the first clock signal from the first oscillation circuit. Therefore, it can be said that the second oscillation circuit serves as a slave and is in a master-slave relationship with the first oscillation circuit serving as a master (i.e., the second clock signal serves as a slave clock signal).

Advantageous Effects of Invention

As has been described, a drive circuit of the present invention is a drive circuit for driving a display section, including: image supplying means for supplying an image to be displayed on the display section; command issuing means for issuing a command that instructs an image displayed on the display section to be updated; a first oscillation circuit for supplying a first clock signal; a second oscillation circuit for supplying a second clock signal that is higher in frequency than the first clock signal; image outputting means for supplying, to the display section, the image supplied from the image supplying means, the image outputting means being driven by the second clock signal; and second oscillation circuit controlling means for controlling, in accordance with the command issued by the command issuing means, whether or not to cause the second oscillation circuit to operate, the second oscillation circuit controlling means being driven by the first clock signal.

This makes it possible to provide a drive circuit and a liquid crystal display device each of which is more power-saving than conventional drive circuits.

DESCRIPTION OF EMBODIMENTS

One embodiment of the present invention is described below with reference to FIGS. 1 to 3.

Figure 1:
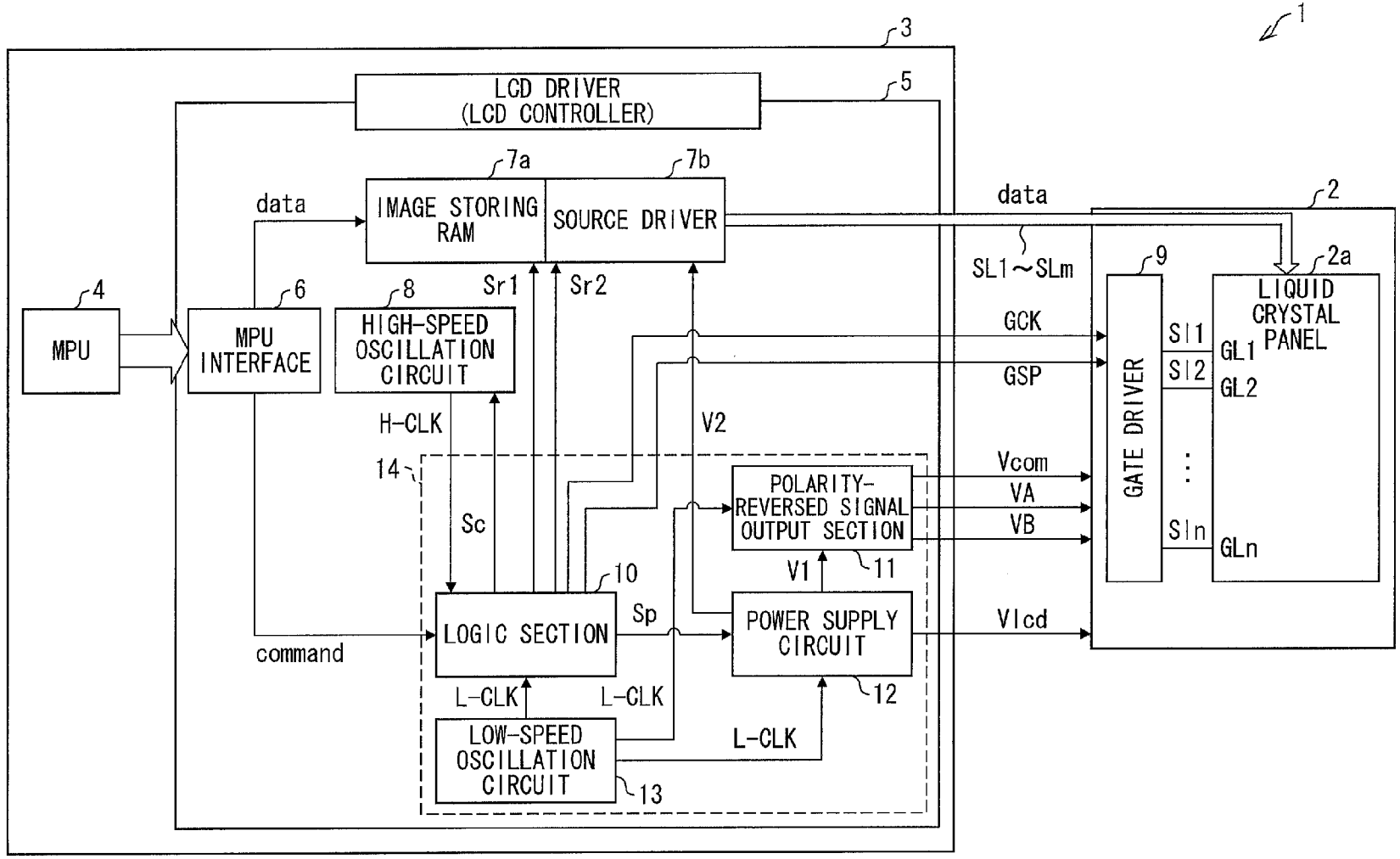
FIG. 1 is a block diagram illustrating a liquid crystal display device in accordance with an embodiment of the present invention.

FIG. 1 is a block diagram illustrating a liquid crystal display device 1 in accordance with the present embodiment. The liquid crystal display device 1 is a liquid crystal display device including pixel memories (described later). Specifically, the liquid crystal display device 1 includes (i) a liquid crystal panel 2 in which a memory circuit 40 (refer to FIG. 4, hereinafter referred to as a pixel memory 40) is included in each pixel and (ii) a liquid crystal panel driving circuit 3 (drive circuit). The liquid crystal panel 2 includes a gate driver 9 (image outputting means). The pixel memories of the liquid crystal panel 2 are described later with reference to FIG. 4. The liquid crystal panel driving circuit 3 is a drive circuit which drives the liquid crystal panel 2 (display section), and is constituted by for example an LSI (Large Scale Integrated circuit).

[Liquid Crystal Panel Driving Circuit 3]

The liquid crystal panel driving circuit 3 includes an MPU (Micro-Processing Unit) 4 and an LCD (liquid crystal display) driver 5 (LCD controller). The MPU 4 contains an image supply section (image supplying means) and a command issuing section (command issuing means).

The LCD driver 5 includes an MPU interface 6, an image storing RAM (Random Access Memory) 7*a* (image storing means), a source driver 7*b* (image outputting means), a high-speed oscillation circuit 8 (second oscillation circuit), a logic section 10 (second oscillation circuit controlling means), a polarity-reversed signal output section 11 (polarity reversing means), a power supply circuit 12 (booster circuit), and a low-speed oscillation circuit 13 (first oscillation circuit). The gate driver 9 can be included in the LCD driver 5 instead of being included in the liquid crystal panel 2, and the power supply circuit 12 can be provided outside the LCD driver 5.

The source driver 7*b* and the gate driver 9 are driven by a high-speed clock signal H-CLK (second clock signal, described later), and supply, to the liquid crystal panel 2, an image received from the image supply section. The gate driver 9 is constituted by for example a TG (Timing Generator).

A block 14 enclosed by a dotted line in the LCD driver 5 shown in FIG. 1 is a block that is operated by a low-speed clock signal L-CLK (first clock signal) supplied from the low-speed oscillation circuit 13, and is required to operate constantly. The block 14 includes the logic section 10, the polarity-reversed signal output section 11, and the power supply circuit 12. The power supply circuit 12 supplies a power supply voltage V1*cd* to the pixel memories 40 of the liquid crystal panel 2, and supplies electric power P to the liquid crystal panel 2. The power supply circuit 12 further supplies an internal circuit power supply voltage to an internal circuit of the liquid crystal panel drive circuit 3, which is an IC (Integrated Circuit). The power supply circuit further supplies a power supply voltage V1 to the polarity-reversed signal output section 11 and supplies a power supply voltage V2 to the source driver 7*b*.

Supplying the power supply voltage V1 to the polarity-reversed signal output section 11 increases the capability of a signal that the polarity-reversed signal output section 11 outputs, and thus prevents the polarity reversal from taking a long time. Further, the source driver 7*b* charges source bus lines SL1 to SLm by receiving the power supply voltage V2.

Note that the power supply voltage V2 does not need to be supplied while images are not rewritten.

The polarity-reversed signal output section 11 supplies signals VA and VB to the liquid crystal panel 2, and supplies a signal Vcom (polarity reversal signal) to a common electrode COM of the liquid crystal panel 2.

According to the liquid crystal panel drive circuit 3, image data is supplied from the image supply section of the MPU 4 to the image storing RAM 7*a* via the MPU interface 6, and is written to the image storing RAM 7*a*. In this way, an image to be displayed on the liquid crystal panel 2 is supplied. The image data is written in accordance with a write pulse (pulse signal) supplied from the MPU 4, which write pulse serves as a clock signal (write clock signal). Therefore, it is not necessary to provide an oscillation circuit exclusively for writing image data.

Upon completion of writing the image data to the image storing RAM 7*a*, the command issuing section of the MPU 4 issues a command instructing an image displayed on the liquid crystal panel 2 to be updated.

The logic section 10 is driven by the low-speed clock signal L-CLK and controls, in accordance with the command issued by the command issuing section, whether or not to cause the high-speed oscillation circuit 8 to operate. For example, upon receiving the command issued by the MPU 4 via the MPU interface 6, the logic section 10 changes, from L (low) to H (high), an operation control signal Sc which is supplied to the high-speed oscillation circuit 8. This causes the high-speed oscillation circuit 8 to start operating. The logic section 10 is constantly receiving the low-speed clock signal L-CLK in addition to the command.

Upon receiving an H operation control signal Sc, the high-speed oscillation circuit 8 supplies a high-speed clock signal H-CLK (second clock signal) to the logic section 10. Upon receiving the high-speed clock signal H-CLK, the logic section 10 first supplies a gate start pulse signal GSP and a gate clock signal GCK to the gate driver 9. The logic section 10 then supplies a control signal group Sr1 to the image storing RAM 7*a* and supplies a control signal group Sr2 to the source driver 7*b*.

In response to the signals supplied from the logic section 10 like above, the image data is supplied from the image storing RAM 7*a* to the liquid crystal panel 2 via the source driver 7*b*, and selection signals S11, •S12, • . . . •and S1*n* are supplied from the gate driver 9 to the display region 2*a* of the liquid crystal panel 2. This causes the image to be displayed on the liquid crystal panel 2.

The image data (digital signal) written to the image storing RAM 7*a* is supplied via the source bus lines SL1 to SLm (SL1, •SL2 • . . . and •SLm) provided between the source driver 7*b* and the liquid crystal panel 2.

It should be noted that the supply of the high-speed clock signal H-CLK is started and stopped within a period of time from when the logic section 10 has received the command via the MPU interface 6 until a total transfer period TT (described later) has passed.

Further, according to the above description, the high-speed oscillation circuit 8 supplies the high-speed clock signal H-CLK upon receiving the operation control signal Sc that is changing from L to H. Note, however, that the high-speed oscillation circuit 8 can be configured to supply the high-speed clock signal H-CLK upon receiving the operation control signal Sc that is changing from H to L.

Moreover, upon receiving the command, the logic section 10 supplies a power capability change signal Sp to the power supply circuit 12 to thereby increase the power capability. How to change the power capability is described in the following [Operation of liquid crystal panel 2].

As has been described, the high-speed oscillation circuit 8, which needs to be controlled locally, is controlled to operate or not to operate by the operation control signal Sc supplied from the logic section 10. Note, however, that the logic section 10 operates in accordance with the low-speed clock signal L-CLK from the low-speed oscillation circuit 13. Further, the low-speed oscillation circuit 13 serves as a master of the entire liquid crystal panel driving circuit 3, which is an LSI. That is, the high-speed oscillation circuit 8 serves as a slave, and is in a master-slave relationship with the low-speed oscillation circuit 13 serving as the master.

[Configuration of Liquid Crystal Panel 2]

The liquid crystal panel 2 shown in FIG. 1 is an active matrix liquid crystal display panel which (i) has a display region (active area) 2*a* in which a pixel memory is included in each pixel and (ii) includes a plurality of gate bus lines GL1, •GL2, • . . . •and GLn and a plurality of source bus lines SL1 to S1*m*. The liquid crystal panel 2 can be constituted, in addition to the above constituents, by polycrystalline silicon, CG (Continuous Grain) silicon, and/or microcrystalline silicon etc. The display region 2*a* is a region where a plurality of pixels are arranged in a matrix manner.

The plurality of gate bus lines GL1, •GL2, • . . . •and GLn are connected to the gate driver 9 of the liquid crystal panel 2, and are supplied with selection signals S11, •S12, • . . . •and S1*n*. The plurality of source bus lines SL1 to SLm are connected to the source driver 7*b* of the liquid crystal driving circuit 3, are supplied with respective pieces of image data.

[Configuration of Pixel in Liquid Crystal Panel 2]

Figure 4:
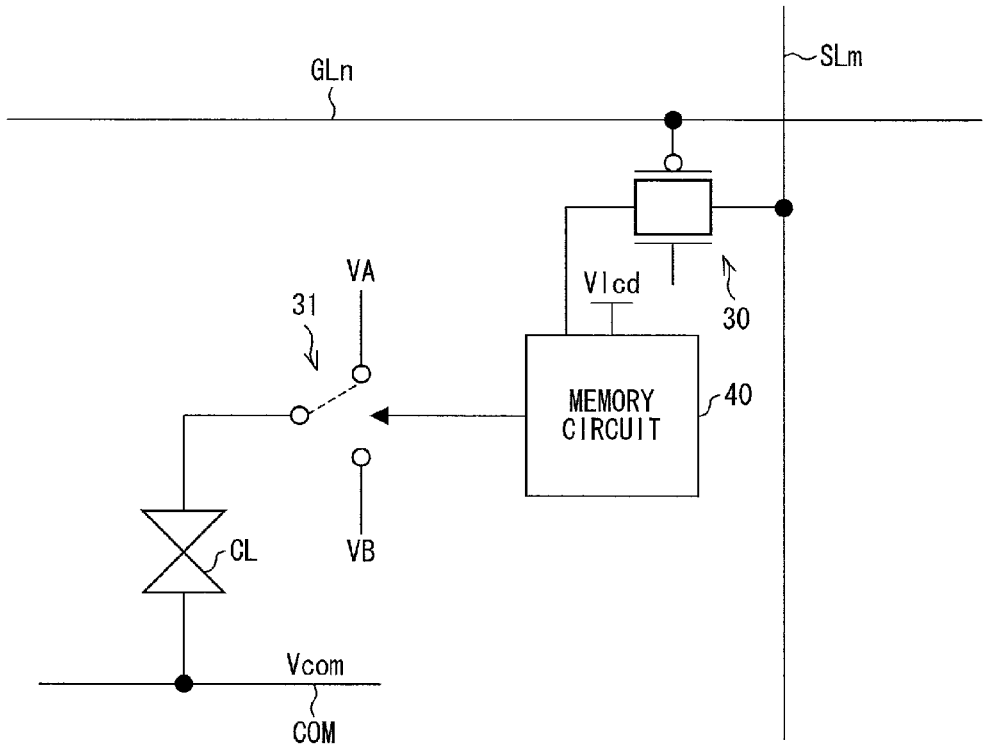
FIG. 4 is a circuit diagram illustrating a configuration of a pixel of a liquid crystal panel in accordance with the embodiment of the present invention.

FIG. 4 is a circuit diagram illustrating a configuration of a pixel of the liquid crystal panel 2 in accordance with the present embodiment.

The pixel of the liquid crystal panel 2 is constituted by: a TFT (Thin Film Transistor) 30, which is a selective element for the pixel; a liquid crystal capacitance CL; a pixel memory 40, which is a pixel memory constituted by a TFT; and a switching element 31 constituted by a TFT and switches between a signal VA and a signal VB to be supplied to the liquid crystal capacitance CL. Since the TFT 30 is used as a switching element, it is possible to reduce the thickness of the display panel 2. Further, since the pixel includes the memory element 40, the pixel can retain data of a still image.

The gate of the TFT 30 is connected to one of the gate bus lines GL1, •GL2, • . . . •and GLn. The source of the TFT30 is connected to one of the source bus lines SL1 to S1*m*. The drain of the TFT 30 is connected to an input terminal of the pixel memory 40. The switching element 31 supplies the signal VA or the signal VB to one end of the liquid crystal capacitance CL, in accordance with an output signal from the pixel memory 40. The other end of the liquid crystal capacitance CL is connected to the common electrode COM. The pixel memory 40 is for example an SRSM, and is supplied with a power supply voltage V1*cd*.

Figure 5:
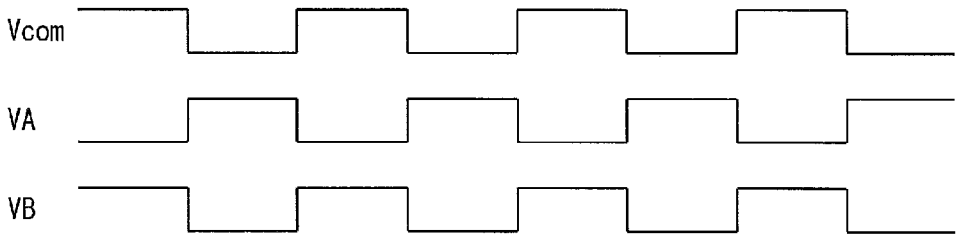
FIG. 5 is a timing chart showing signals supplied to pixels of the liquid crystal panel in accordance with the embodiment of the present invention.
Figure 6:
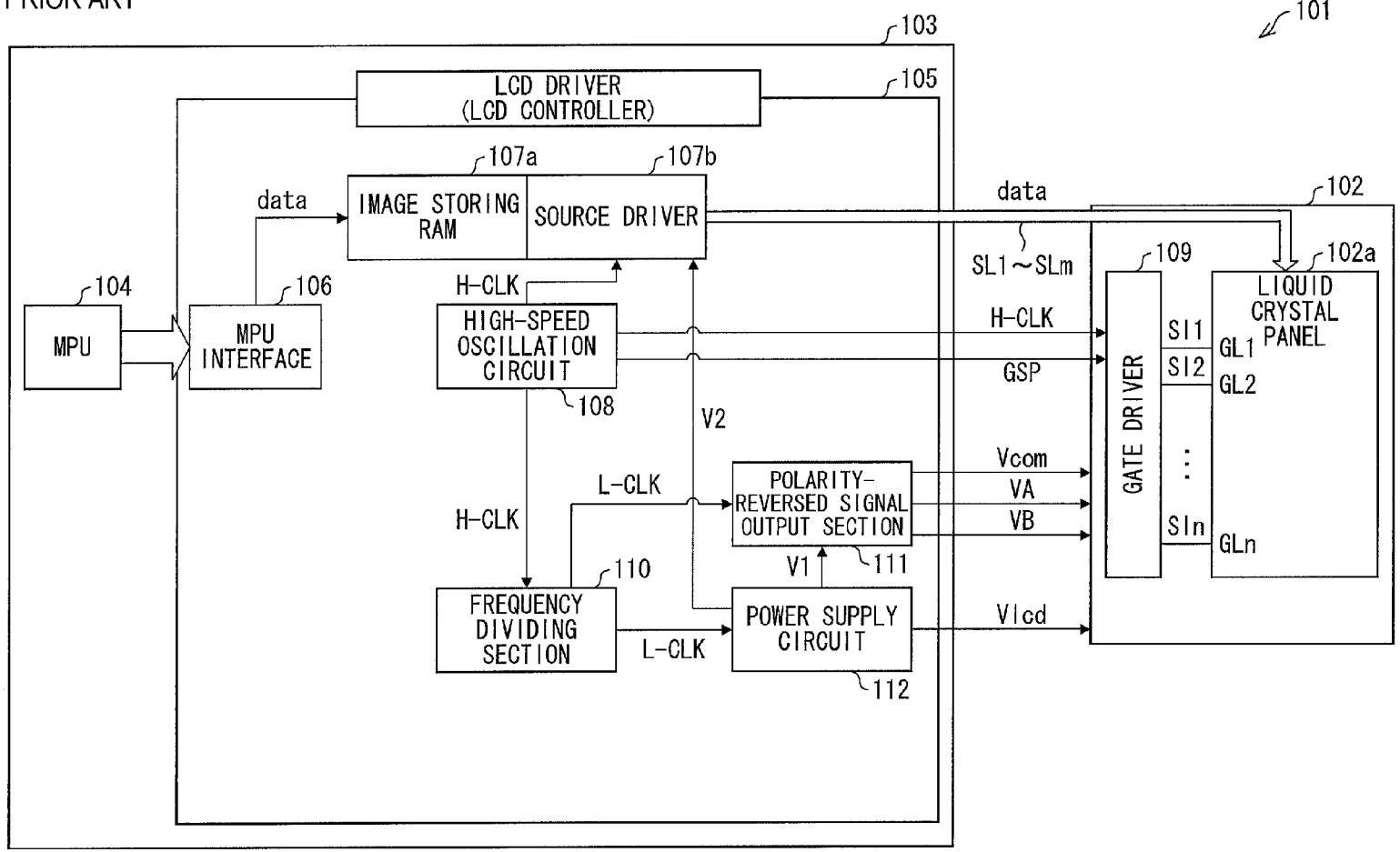
FIG. 6 PRIOR ART
FIG. 6 is a block diagram illustrating a conventional liquid crystal display device.
Figure 7:
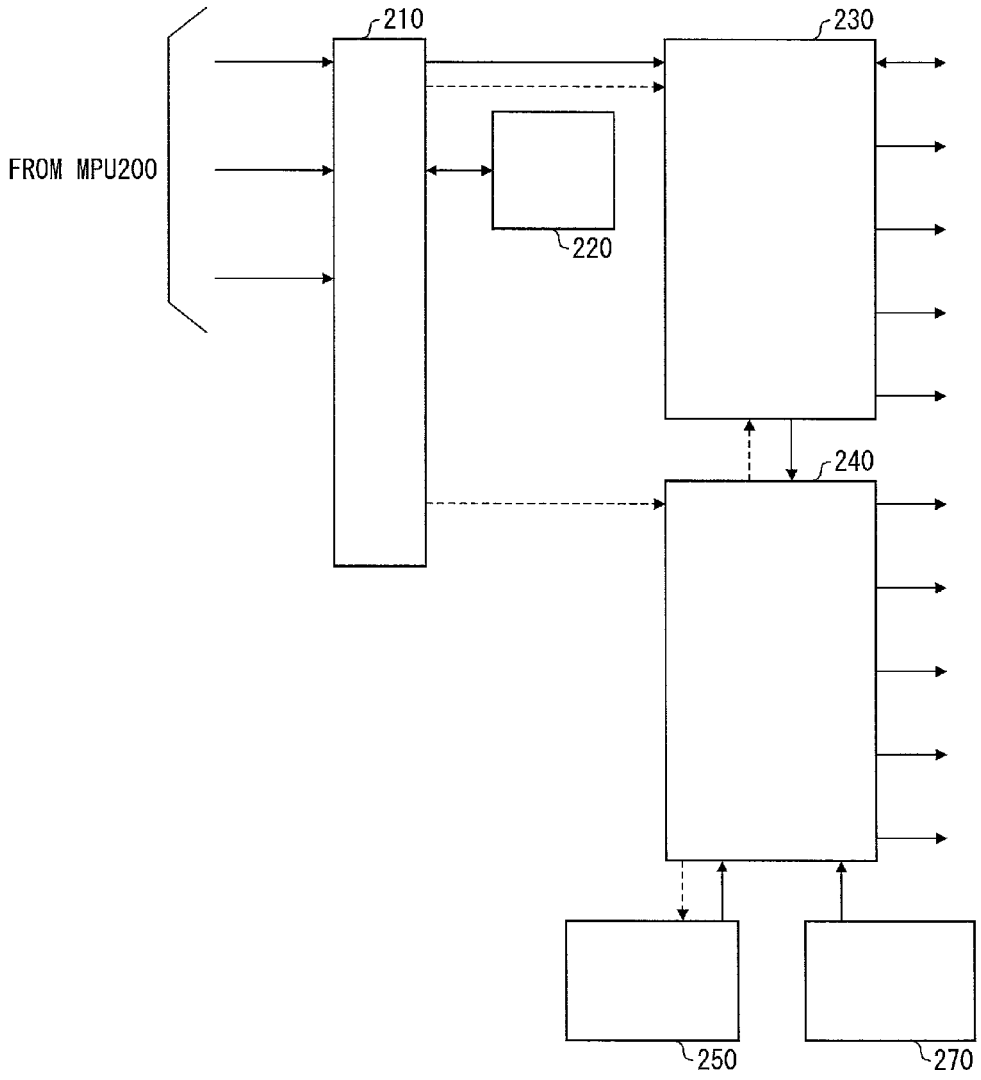
FIG. 7 PRIOR ART
FIG. 7, corresponding to FIG. 1 of Patent Literature 1, is a block diagram illustrating a conventional liquid crystal driving device.
Figure 8:
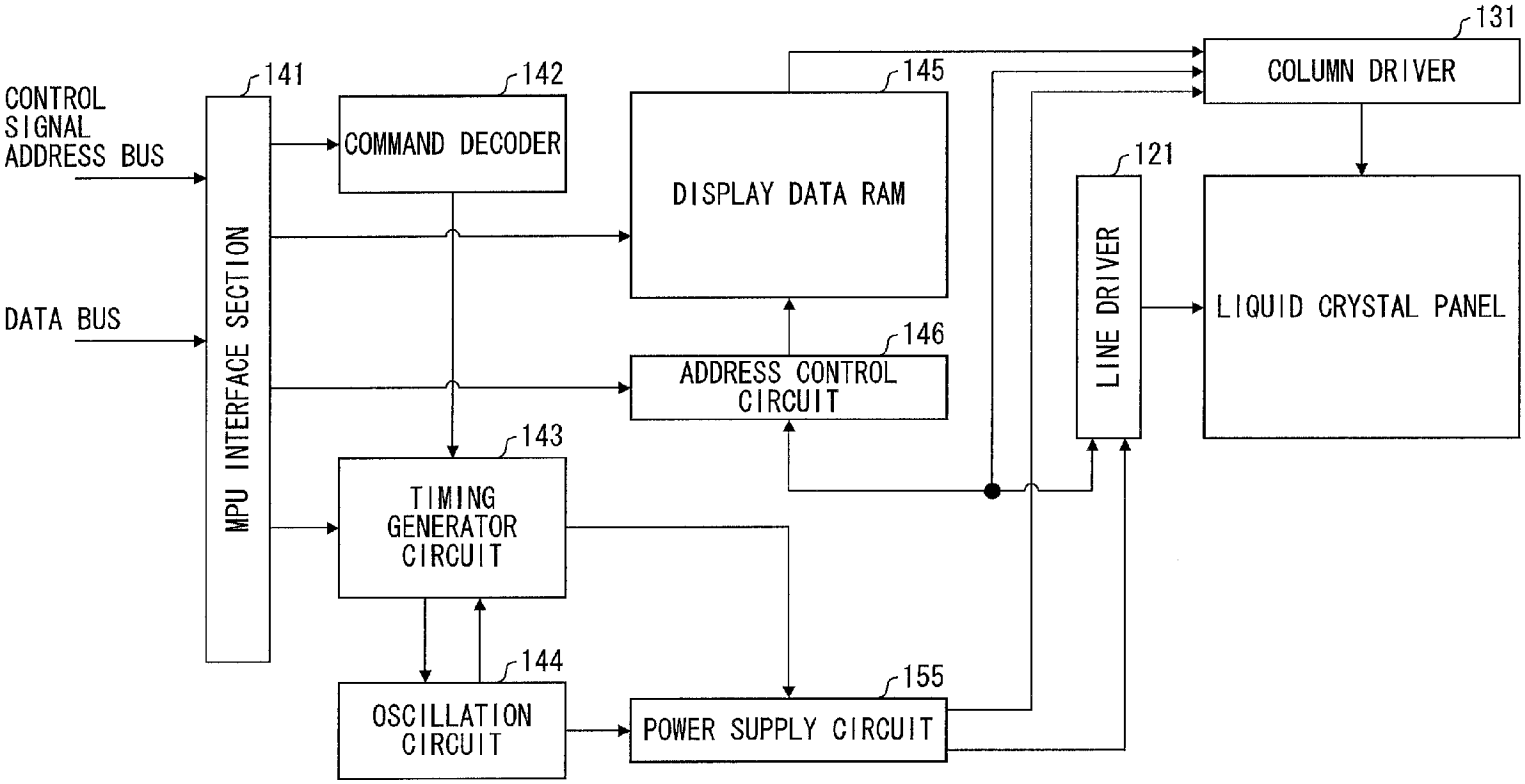
FIG. 8 PRIOR ART
FIG. 8, corresponding to FIG. 1 of Patent Literature 2, is a block diagram illustrating a conventional drive circuit.

FIG. 5 is a timing chart showing the signals Vcom, VA, and VB supplied to pixels of the liquid crystal panel 2 in accordance with the present embodiment. The signal VA has a polarity identical to that of the signal Vcom supplied to the common electrode COM, and is a white signal in a case of normally white. The signal VB has a polarity reverse to that of the signal Vcom supplied to the common electrode COM, and is a black signal in a case of normally white.

The pixel of the liquid crystal panel 2 is caused to retain a pixel value by (i) supplying the power supply voltage V1*cd* to the pixel memory 40 and (ii) constantly applying an AC voltage to the liquid crystal capacitance CL by reversing the signals Vcom, VA, and VB periodically as shown in FIG. 5.

Let the cycle in which the signals Vcom, VA, and VB are reversed be polarity reversal cycle TTr, the time required for the polarity reversal be polarity reversal period Tr, and the time during which the polarities are maintained be polarity maintain period Tk. In this case, the following equations (1) and (2) hold.

$$TTr=Tr+Tk \quad (1)$$

$$Tr<<Tk \quad (2)$$

The polarity reversal cycle TTr for the signals Vcom, VA, and VB is very long, and is for example one (1) second. The polarity reversal period Tr is for example approximately 100 microseconds.

The power supply circuit 12 increases its outputting electric power P only during the polarity reversal period Tr, which is much shorter than the polarity maintain period Tr. During the polarity maintain period Tk which accounts for a large part of the polarity reversal cycle TTr, it is only necessary that the power supply circuit 12 supply electric power to the pixel memory 40. Therefore, during the polarity maintain period Tk, the electric power P that the power supplied circuit 12 supplies can further be reduced.

Accordingly, it is possible to reduce the total electric power consumed during the polarity reversal cycle TTr, as compared to a conventional drive circuit. This makes it possible to achieve higher power saving effects than the conventional drive circuit.

It should be noted that liquid crystal of the liquid crystal panel 2 is basically monochrome liquid crystal having no gray scale.

[Driving of Liquid Crystal Panel 2]

Figure 2:
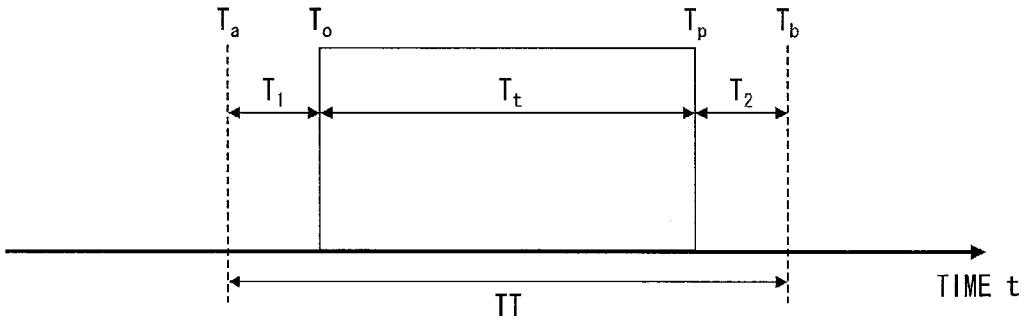
FIG. 2 is a timing chart showing timings at which supply of a high-speed clock signal is started and stopped and timings at which the capability of a power supply is changed, in the liquid crystal panel in accordance with the embodiment of the present invention.

FIG. 2 is a timing chart showing timings at which supply of a high-speed clock signal H-CLK is started and stopped and timings at which the capability of a power supply is changed, in the liquid crystal panel 2 in accordance with the present embodiment.

As used in the present embodiment, the phrase "change the capability of a power supply" means "changing the amount of electric power that the power supply circuit 12 supplies". In a case where the power supply circuit 12 is for example a charge pump power supply circuit which generates an output voltage higher than an input voltage by using charge and discharge of a capacitor of the power supply circuit 12, the capability of the power supply can be increased (the amount of electric power that the power supply circuit 12 supplies can be increased) by increasing the frequency at which the charge pump operates.

Further, the phrase "reduce the capability of a power supply" means "further reducing the amount of the electric power that the power supply circuit 12 supplies" (power saving). Reducing the capability of the power supply of the foregoing charge pump circuit further reduces the frequency at which the charge pump operates. This makes the charge pump power supply circuit consume less electric power. The amount by which the electric power that the power supply circuit itself consumes is reduced is generally in the order of μW (for example, reduced from 500 μW to 250 μW). Reducing the electric power consumption by an amount on the order of μW is important. This is because the liquid crystal panel 2 consumes little electric power when the liquid crystal panel 2 is retaining an image.

The power supply circuit 12 supplies, to the liquid crystal panel 2, either a first electric power or a second electric power that has a value larger than the first electric power. The first electric power and the second electric power each serve as electric power P.

According to the timing chart shown in FIG. 2, at time Ta (first time), a command is supplied to the logic section 10. Next, during time period $T_1$ (first time period) from time Ta to time To (second time), the logic section 10 supplies an operation control signal Sc to the high-speed oscillation circuit 8. This causes the high-speed oscillation circuit 8 to start operating and supplying a high-speed clock signal H-CLK. Meanwhile, the logic section 10 supplies a power capability change signal Sp to the power supply circuit 12 to thereby increase the power capability (polarity of the signal Vcom supplied to the common electrode COM is being reversed or writing to the pixel memory is being carried out). Note, however, that the supply of the high-speed clock signal H-CLK and the increase of the power capability do not have to be carried out simultaneously. Further, it is only necessary that the power capability change signal Sp be changed from L (low) to H (high) to increase the power capability and be changed from H (high) to L (low) to reduce the power capability, for example.

Further, at time To, the logic section 10 receives a signal from the gate driver 9 which signal indicates that the image has been updated. Then, during transfer period Tt (output time period) from time To to time Tp (third time), the image storing RAM 7*a* supplies image data to the liquid crystal panel 2 via the source driver 7*b*, and the gate driver 9 supplies a selection signal S1 to the liquid crystal panel 2. This causes an image to be displayed on the liquid crystal panel 2.

Then, during time period $T_2$ (second time period) from time Tp to time Tb (forth time), the logic section 10 supplies the operation control signal Sc to the high-speed oscillation circuit 8 to thereby stop the operation of the high-speed oscillation circuit 8 and stop supply of the high-speed clock signal H-CLK. Meanwhile, the logic section 10 supplies the power capability change signal Sp to the power supply circuit 12 to thereby reduce the power capability to what it was before the increase (the state where pixel memory only is retained). Note, however, that the supply of the high-speed clock signal H-CLK does not have to be stopped simultaneously with the reduction of the power capability.

As has been described, upon receiving a command, the logic section 10 causes the power supply circuit 12 to supply the second electric power and causes the high-speed oscillation circuit 8 to operate. Then, after receiving a signal from the gate driver 9 which signal indicates that the image has been updated, the logic section 10 causes the power supply circuit 12 to supply the first electric power and stops the operation of the high-speed oscillation circuit 8. In this way, the operation of the high-speed oscillation circuit 8 is started and stopped (that is, supply of the high-speed clock signal H-CLK is started and stopped) and the electric power P that the power supply circuit 12 supplies is increased and reduced (that is, the power capability is increased and reduced) at proper timings, within total transfer period TT from time Ta to time Tb. This makes it possible to cause the liquid crystal panel 2 to operate with minimum electric power consumption.

Note that total transfer period TT (total output period), time $T_1$, time $T_2$, and transfer period Tt satisfy the following equation (3).

$$TT=T_1+Tt+T_2 \quad (3)$$

Figure 3:
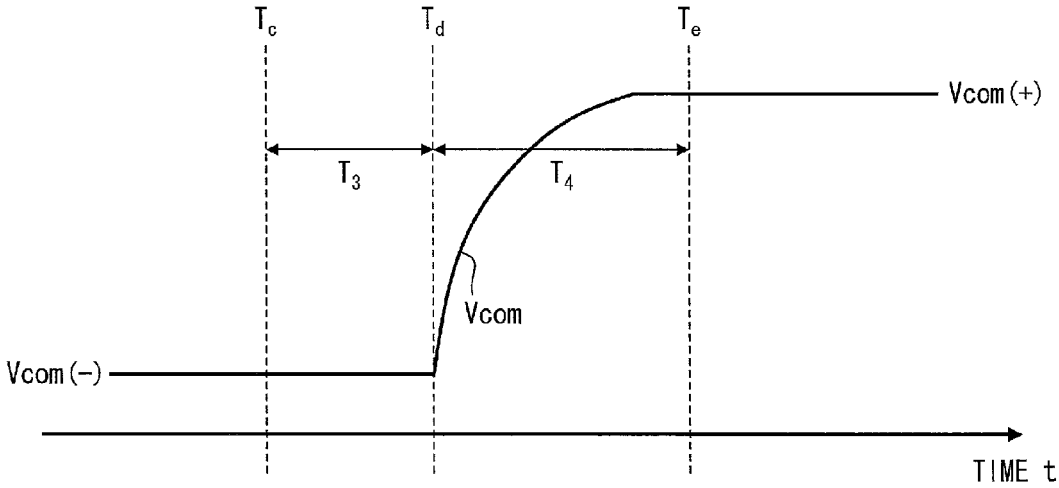
FIG. 3 is a timing chart showing timings of polarity reversal of a signal constantly supplied to a common electrode and timings at which the capability of a power supply is changed, in the liquid crystal panel in accordance with the embodiment of the present invention.

FIG. 3 is a timing chart showing timings of polarity reversal of the signal Vcom which is constantly supplied to the common electrode COM, and timings at which the capability of the power supply is changed, in the liquid crystal panel 2 in accordance with the present embodiment.

It is assumed in FIG. 3 that the polarity of the signal Vcom is negative (that is, Vcom=Vcom (−)). In this situation, the capability of the power capability is increased at time Tc.

Next, at time Td, the polarity of the signal Vcom starts to be reversed.

Then, at time Te which is after time period $T_4$ from time Td, at which time Te the polarity reversal of the signal Vcom is completed, the power capability is reduced to what it was before the increase. At time Te, Vcom=Vcom (+).

As described above, the power supply circuit 12 supplies the second electric power to the liquid crystal panel before the polarity-reversed signal output section 11 reverses the polarity of the signal to be supplied to the common electrode COM, and supplies the first electric power to the liquid crystal panel 2 after the polarity-reversed signal output section 11 has reversed the polarity of the signal to be supplied to the common electrode COM. In this way, the polarity of the signal Vcom is reversed and the power capability is increased and reduced at proper timings, within time period T3+T4 from time Tc to time Te. This makes it possible to cause the liquid crystal panel 2 to operate with minimum electric power consumption.

As described earlier, when a command issued by the MPU4 is supplied to the logic unit 10 via the MPU interface 6, image data is supplied to the liquid crystal panel 2, and the selection signals S11, •S12, • . . . •and S1*n* are supplied from the gate driver 9 to the display region 2*a* of the liquid crystal panel 2. This causes the image to be displayed on the liquid crystal panel 2.

On the other hand, the polarity of the signal Vcom continues reversing in a cycle of for example one (1) second (DUTY 50%) independently of the display of the image.

According to a conventional drive circuit, rewriting of an images and polarity reversal of the signal Vcom are not synchronized, and thus may coincide with each other. If rewriting of an image and polarity reversal of the signal Vcom coincide with each other, coupling may occur due to the polarity reversal of the signal Vcom, and thus the image may not be properly written to the liquid crystal panel.

In a master-slave relationship, it is possible for the logic section 10 operated by the low-speed clock signal L-CLK serving as a master to determine, upon receiving a command that instructs an image to be rewritten, whether or not polarity reversal will occur during total transfer period TT shown in FIG. 2.

If it has been determined that no polarity reversal will occur during total transfer period TT, the image is simply rewritten (updated). On the other hand, if it has been determined that polarity reversal will occur during total transfer period TT, the image is rewritten after the polarity reversal has been completed (after time Te in FIG. 3).

Since the liquid crystal panel driving circuit 3 is capable of controlling timings to prevent rewiring of an image and polarity reversal of the signal Vcom from coinciding with each other as above, it is possible to rewrite the image properly.

Overview of Embodiment

As has been described, according to the liquid crystal driving circuit 3 in accordance with the present embodiment, it is possible to (i) cause the high-speed oscillation circuit 8 to operate when a command that instructs an image displayed on the liquid crystal display 2 to be rewritten is issued and (ii) stop operation of the high-speed oscillation circuit 8 when a command that instructs a still image to be displayed is issued.

That is, according the liquid crystal panel driving circuit 3, the high-speed oscillation circuit 8 does not operate except when the image displayed on the liquid crystal panel 2 is rewritten.

Since the liquid crystal panel driving circuit 3 does not cause the high-speed oscillation circuit 8 to operate constantly like above, the liquid crystal panel driving circuit 3 is more power-saving than conventional drive circuits.

The low-speed clock signal L-CLK supplied from the low-speed oscillation circuit 13 is supplied to the logic section 10, the polarity-reversed signal output section 11, and the power supply circuit 12, which are required to operate constantly.

When an image is rewritten, the liquid crystal panel 2 consumes more electric power than it does while a still image is displayed. Therefore, the logic section 10 causes the power supply circuit 12 to supply more electric power only when necessary, that is, only when much electric power is to be consumed. At other times, the logic section 10 causes the power supply circuit 12 to supply less electric power. This achieves power saving.

According to the above configuration, the high-speed oscillation circuit 8 is caused to operate so that the second electric power is supplied, only when much electric power is consumed. With this, operation of the high-speed oscillation circuit 8 is started and stopped and the electric power is increased and reduced at proper timings. This makes it possible to cause the liquid crystal panel 2 to operate with minimum electric power consumption.

In a case where the power supply circuit 12 is a charge pump power supply circuit which generates an output voltage higher than an input voltage by using charging and discharge of a capacitor, the capability of the power supply is increased (the amount of electric power that the power supply circuit 12 supplies is further increased) by further increasing the frequency at which the charge pump operates. Note that the phrase "reduce the capability of a power supply" means "further reducing the amount of the electric power that the power supply circuit 12 supplies" (power saving).

Out of the two oscillation circuits, the low-speed oscillation circuit 13 serves as a master of the entire liquid crystal panel driving circuit 3, which is an LSI (i.e., the low-speed clock signal L-CLK serves as a master clock signal). This controls the polarity-reversed signal output section 11 and the power supply circuit 12, which are required to operate constantly.

Further, the high-speed oscillation circuit 8, which needs to be controlled locally, is controlled to operate or not to operate by the operation control signal Sc supplied from the logic section 10. Note, however, that the logic section 10 operates in accordance with the low-speed clock signal L-CLK from the low-speed oscillation circuit 13. Therefore, it can be said that the high-speed oscillation circuit 8 serves as a slave and is in a master-slave relationship with the low-speed oscillation circuit 13 serving as the master (i.e., the high-speed clock signal H-CLK serves as a slave clock signal). Accordingly, by cooperation of the low-speed oscillation circuit 13 and the high-speed oscillation circuit 8, the liquid crystal panel driving circuit of the present embodiment becomes more power-saving than the conventional drive circuits.

The liquid crystal panel driving circuit 3 causes minimum required circuits to operate by the low-speed clock signal L-CLK (master clock signal), and further changes the capability of a power supply if necessary. The liquid crystal panel driving circuit 3 further causes the high-speed clock signal H-CLK (slave clock signal) to operate only when more electric power is consumed like when an image is transferred or when a moving image is displayed. As such, the liquid crystal panel driving circuit 3 is a drive circuit to drive the liquid crystal panel 2, and is also a drive circuit (system) more power-saving than conventional drive circuits.

The liquid crystal display device 1 in accordance with the present embodiment includes the liquid crystal panel driving circuit 3 and the liquid crystal panel 2, and thus is more power-saving than conventional techniques.

The drive circuit can further include a power supply circuit for supplying, to the display section, either a first electric power or a second electric power that has a value larger than the first electric power, and can be configured such that: upon receiving the command, the second oscillation circuit controlling means causes the power supply circuit to supply the second electric power and causing the second oscillation circuit to operate; and after receiving from the image outputting means a signal indicating that the image has been updated, the second oscillation circuit controlling means causes the power supply circuit to supply the first electric power and causing the second oscillation circuit to stop operating.

The first clock signal supplied from the first oscillation circuit is supplied to the second oscillation circuit controlling means and the power supply circuit, which are required to operate constantly.

When an image displayed on the display section is rewritten, the display section consumes more electric power than it does while a still image is displayed. Therefore, the second oscillation circuit controlling means causes the power supply circuit to supply more electric power only when necessary, that is, only when much electric power is consumed. At other times, the second oscillation circuit controlling means causes the power supply circuit to supply less electric power. This achieves power saving.

According to the configuration, the second oscillation circuit is caused to operate so that the second electric power is supplied, only when much electric power is consumed. With this, operation of the second oscillation circuit is started and stopped and the electric power is increased and reduced at proper timings. This makes it possible to cause the display section to operate with minimum electric power consumption.

The drive circuit can further include a power supply circuit for supplying, to the display section, either a first electric power or a second electric power that has a value larger than the first electric power, and can be configured such that the first electric power and the second electric power supplied from the power supply circuit to the display section are switched every time polarity of a signal supplied to the common electrode of the display section is reversed.

Since the polarity of the signal is reversed and the electric power is increased and reduced at proper timings, it is possible to cause the display section to operate with minimum electric power consumption. Further, when the command issued by the command issuing means is supplied to the second oscillation circuit controlling means, image data is supplied to the display section and a selection signal is supplied from the image outputting means to the display region of the display section. This causes the image to be displayed on the display section.

On the other hand, the polarity of the signal supplied to the common electrode of the display section continues reversing in a cycle of for example one (1) second (DUTY 50%) independently of the display of the image.

According to a conventional drive circuit, rewriting of an image and polarity reversal of the signal supplied to the common electrode of the display section are not synchronized, and thus may coincide with each other. If rewriting of an image and polarity reversal of the signal supplied to the common electrode of the display section coincide with each other, coupling may occur due to the polarity reversal of the signal supplied to the common electrode of the display region, and thus the image may not be properly written to the display region.

Since the configuration employs a master-slave relationship, it is possible for the second oscillation circuit controlling means operated by the first clock signal serving as a master to determine, upon receiving the command that instructs an image to be rewritten, whether or not polarity reversal will occur during the total transfer period.

If it has been determined that no polarity reversal will occur during the total transfer period, the image is simply rewritten (updated). On the other hand, if it has been determined that the polarity reversal will occur during the total transfer period, the image is rewritten after the polarity reversal has been completed.

Since the drive circuit is capable of controlling timings to prevent rewiring of an image and polarity reversal of the signal supplied to the common electrode of the display section from coinciding with each other, it is possible to rewrite the image properly.

The drive circuit can be configured such that the power supply circuit is a charge pump power supply circuit which generates an output voltage higher than an input voltage by using charge and discharge of a capacitor of the power supply circuit.

According to the configuration, the amount of the electric power that the power supply circuit supplies can be further increased by increasing the frequency at which the charge pump operates.

The drive circuit can be configured such that the display section is a liquid crystal panel in which a memory circuit is included in each pixel. According to the configuration, when a still image is displayed, it is only necessary that data of the sill image be retained in a memory circuit. This makes it unnecessary to continue to sending images.

A liquid crystal display device of the present invention includes any one of the above drive circuits and the liquid crystal panel. Therefore, the liquid crystal device is more power-saving than conventional techniques.

The present invention is not limited to the descriptions of the respective embodiments, but may be altered within the scope of the claims. An embodiment derived from a proper combination of technical means disclosed in different embodiments is encompassed in the technical scope of the invention.

INDUSTRIAL APPLICABILITY

A drive circuit of the present invention is more power-saving than conventional drive circuits, and is suitably applicable to a liquid crystal display device including a liquid crystal panel in which a memory circuit is included in each pixel.

REFERENCE SIGNS LIST

1 Liquid crystal display device
2 Liquid crystal panel (display section)
2*a* Display region
3 Liquid crystal panel driving circuit (drive circuit)
4 MPU (image supplying means, command issuing means)
5 LCD driver
6 MPU interface
7*a* Image storing RAM
7*b* Source driver (image outputting means)
8 High-speed oscillation circuit (second oscillation circuit)
9 Gate driver (image outputting means)
10 Logic section (second oscillation circuit controlling means)
11 Polarity-reversed signal output section (polarity reversing means)
12 Power supply circuit
13 Low-speed oscillation circuit (first oscillation circuit)
14 Block
30 TFT
31 Switching element
40 Memory circuit
CL Liquid crystal capacitance
COM Common electrode
GCK Gate clock signal
GL1, •GL2 • . . . •and GLn Gate bus line
GSP Gate start pulse signal
H-CLK High-speed clock signal (second clock signal)
L-CLK Low-speed clock signal (first clock signal)
P Electric power
PIX Pixel
SL1 to SLm Source bus line
Sc Operation control signal
S11, •S12, • . . . • and S1*n* Selection signal
Sp Power capability change signal
Sr1, Sr2 Control signal group
$T_1$ Time period (first time period)
$T_2$ Time period (second time period)
$T_3$, $T_4$ Time period
TT Total transfer period
TTr Polarity reversal cycle
Ta Time (first time)
Tb Time (forth time)
Tc, Td, Te Time
Tk Polarity maintain period
To Time (second time)
Tp Time (third time)
Tr Polarity reversal period
Tt Transfer period
V1, V2 Power supply voltage
VA, VB Signal
Vcom Signal
V1*cd* Power supply voltage
command Command
data Data

The invention claimed is:

1. A drive circuit for driving a display section, comprising:

an image supplying device configured to supply an image to be displayed on the display section;

a command issuing device configured to issue a command that instructs an image displayed on the display section to be updated;

a first oscillation circuit configured to supply a first clock signal;

a second oscillation circuit configured to supply a second clock signal that is higher in frequency than the first clock signal;

an image outputting device configured to supply, to the display section, the image supplied from the image supplying device, the image outputting device being driven by the second clock signal;

a second oscillation circuit controlling device configured to control, in accordance with the command issued by the command issuing device, whether or not to cause the second oscillation circuit to operate, the second oscillation circuit controlling device being driven by the first clock signal; and a power supply circuit configured to supply, to the display section, one of a first electric power and a second electric power that has a value larger than the first electric power, wherein upon receiving the command, the second oscillation circuit controlling device causes means causing the power supply circuit to supply the second electric power and causes the second oscillation circuit to operate, and after receiving a signal indicating that the image has been updated from the image outputting device, the second oscillation circuit controlling device causes the power supply circuit to supply the first electric power and causing the second oscillation circuit to stop operating.

2. The drive circuit according to claim 1, wherein the power supply circuit is a charge pump power supply circuit which generates an output voltage higher than an input voltage by using charge and discharge of a capacitor of the power supply circuit.

3. The drive circuit according to claim 2, wherein the power supply circuit is configured to supply the first electric power when a frequency at which the power supply circuit operates is a first frequency, and the power supply circuit is configured to supply the second electric power when the frequency at which the power supply circuit operates is a second frequency which is higher than the first frequency.

4. The drive circuit according to claim 1, wherein the display section is a liquid crystal panel in which a memory circuit is included in each pixel.

5. A drive circuit for driving a display section, comprising:

an image supplying device configured to supply an image to be displayed on the display section;

a command issuing device configured to issue a command that instructs an image displayed on the display section to be updated;

a first oscillation circuit configured to supply a first clock signal;

a second oscillation circuit configured to supply a second clock signal that is higher in frequency than the first clock signal;

an image outputting device configured to supply, to the display section, the image supplied from the image supplying device, the image outputting device being driven by the second clock signal;

a second oscillation circuit controlling device configured to control, in accordance with the command issued by the command issuing device, whether or not to cause the second oscillation circuit to operate, the second oscillation circuit controlling device being driven by the first clock signal; and a power supply circuit configured to supply, to the display section, one of a first electric power and a second electric power that has a value larger than the first electric power, wherein when a polarity of a signal supplied to a common electrode of the display section is reversed, the power supply circuit switches between the first electric power and the second electric power to be supplied to the display section, the power supply circuit is a charge pump power supply circuit with is configured to generate an output voltage higher than an input voltage by using a charging and a discharging of a capacitor of the power supply power circuit, the power supply circuit is configured to supply the first electric power when a frequency at which the power supply circuit operates is a first frequency, and the power supply circuit is configured to supply the second electric power when the frequency at which the power supply circuit operates is a second frequency which is higher than the first frequency.

6. The drive circuit according to claim 5, wherein the display section is a liquid crystal panel in which a memory circuit is included in each pixel.

7. A liquid crystal display device comprising:

a display section; and a drive circuit configured to drive the display section, including:

an image supplying device configured to supply an image to be displayed on the display section;

a command issuing device configured to issue a command that instructs an image displayed on the display section to be updated;

a first oscillation circuit configured to supply a first clock signal;

a second oscillation circuit configured to supply a second clock signal that is higher in frequency than the first clock signal;

an image outputting device configured to supply, to the display section, the image supplied from the image supplying device, the image outputting device being driven by the second clock signal;

a second oscillation circuit controlling device configured to control, in accordance with the command issued by the command issuing device, whether or not to cause the second oscillation circuit to operate, the second oscillation circuit controlling device being driven by the first clock signal; and a power supply circuit configured to supply, to the display section, one of a first electric power and a second electric power that has a value larger than the first electric power, wherein upon receiving the command, the second oscillation circuit controlling device causes the power supply circuit to supply the second electric power and causes the second oscillation circuit to operate, after receiving a signal indicating that the image has been updated from the image outputting device, the second oscillation circuit controlling device causes the power supply circuit to supply the first electric power and causing the second oscillation circuit to stop operating, and the display section is a liquid crystal panel including pixels and a memory circuit included in each of the pixels.

8. A liquid crystal display device comprising:

a display section; and a drive circuit configured to drive the display section, including:

an image supplying device configured to supply an image to be displayed on the display section;

a command issuing device configured to issue a command that instructs an image displayed on the display section to be updated;

a first oscillation circuit configured to supply a first clock signal;

a second oscillation circuit configured to supply a second clock signal that is higher in frequency than the first clock signal;

an image outputting device configured to supply, to the display section, the image supplied from the image supplying device, the image outputting device being driven by the second clock signal;

a second oscillation circuit controlling device configured to control, in accordance with the command issued by the command issuing device, whether or not to cause the second oscillation circuit to operate, the second oscillation circuit controlling device being driven by the first clock signal; and a power supply circuit configured to supply, to the display section, one of a first electric power and a second electric power that has a value larger than the first electric power, wherein when a polarity of a signal supplied to a common electrode of the display section is reversed, the power supply circuit switches between the first electric power and the second electric power to be supplied to the display section, the power supply circuit is a charge pump power supply circuit with is configured to generate an output voltage higher than an input voltage by using a charging and a discharging of a capacitor of the power supply power circuit, the power supply circuit is configured to supply the first electric power when a frequency at which the power supply circuit operates is a first frequency, the power supply circuit is configured to supply the second electric power when the frequency at which the power supply circuit operates is a second frequency which is higher than the first frequency, and the display section is a liquid crystal panel including pixels and a memory circuit included in each of the pixels.

* * * * *